US008258392B2

(12) United States Patent
Mori

(10) Patent No.: US 8,258,392 B2
(45) Date of Patent: Sep. 4, 2012

(54) STROKE SENSING DEVICE FOR PERCUSSION INSTRUMENTS

(75) Inventor: Yoshiaki Mori, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 13/091,022

(22) Filed: Apr. 20, 2011

(65) Prior Publication Data

US 2012/0000345 A1 Jan. 5, 2012

(30) Foreign Application Priority Data

Jul. 1, 2010 (JP) ..... 2010-151263

(51) Int. Cl.
*G10H 3/14* (2006.01)

(52) U.S. Cl. ..... 84/730; 84/422.1

(58) Field of Classification Search ..... 84/721, 84/730, 746, 422.1
See application file for complete search history.

(56) References Cited

U.S. PATENT DOCUMENTS 5,062,341 A * 11/1991 Reiling et al. ..... 84/702
5,177,311 A * 1/1993 Suzuki et al. ..... 84/600
6,683,240 B1 1/2004 Cubranich
6,794,569 B2 9/2004 Kamijima et al.
7,598,445 B1 10/2009 Johnston
7,608,771 B2 10/2009 Fournier et al.

FOREIGN PATENT DOCUMENTS

| | | |
|---|---|---|
| GB | 2 183 076 | 5/1987 |
| JP | 54-146219 | 10/1979 |
| JP | 2000-298474 | 10/2000 |
| JP | 2004-037746 | 2/2004 |
| JP | 2006-133530 | 5/2006 |

OTHER PUBLICATIONS

English Machine translation of Japanese patent application No. 2000-298474.
English Machine translation of Japanese patent application No. 2004-037746.
English Machine translation of Japanese patent application No. 2006-133530.
English translation of Japanese patent application No. S54-146219.

* cited by examiner

*Primary Examiner* — Jeffrey Donels
(74) *Attorney, Agent, or Firm* — Foley & Lardner LLP

(57) ABSTRACT

A percussion instrument striking detection device is configured to minimize time lag from striking the head until detection of head vibrations and for reliable detection of the vibrations in conformance with the striking force without regard to the head condition. A striking member has a vibration sensor. Therefore, the distance from the striking location on the head to the vibration sensor can be short, to minimize time lag. In addition, the effect of the tension or the material of the head on the vibrations detected by the vibration sensor can be minimized and vibrations in conformance with the striking force can be reliably detected.

24 Claims, 5 Drawing Sheets

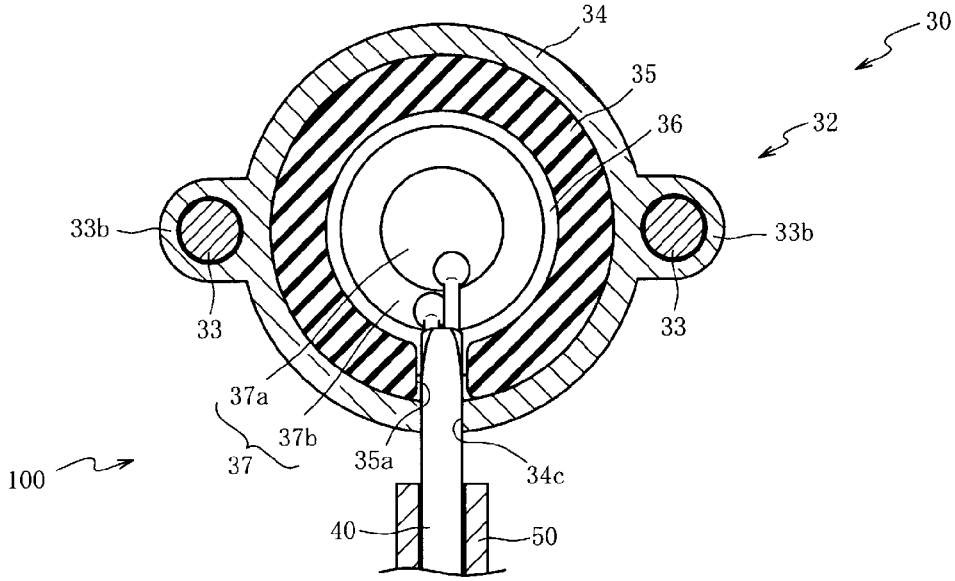
Fig. 3 ( a )
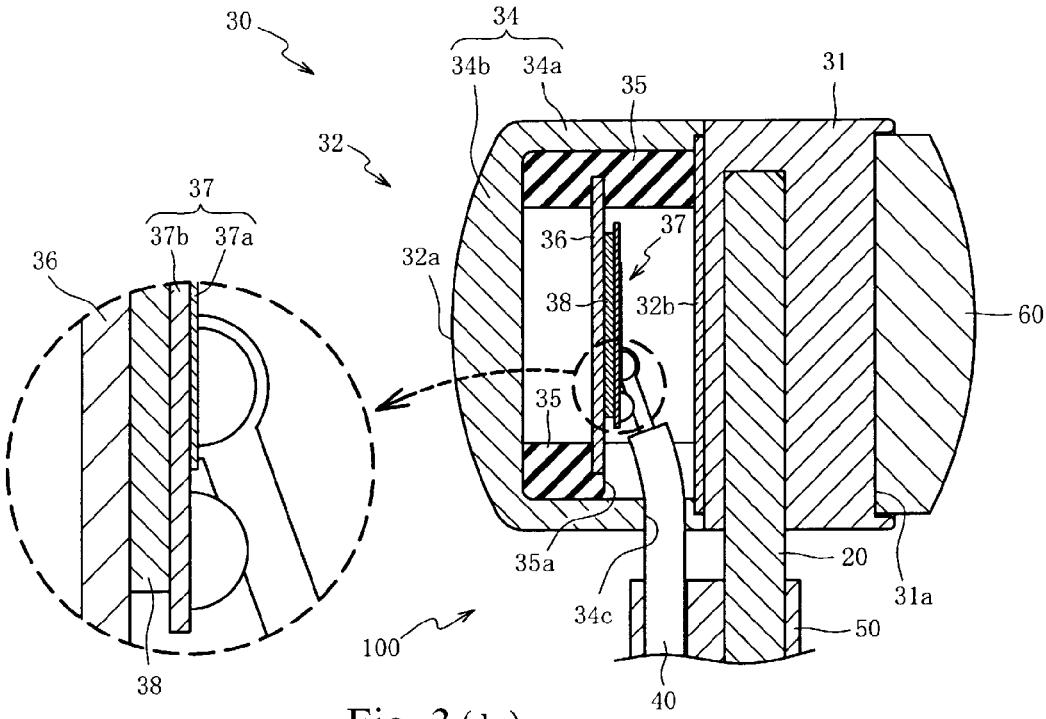
Fig. 3 ( b )

STROKE SENSING DEVICE FOR PERCUSSION INSTRUMENTS

CROSS-REFERENCE TO RELATED PATENT APPLICATIONS

Japan Priority Application 2010-151263, filed Jul. 1, 2010 including the specification, drawings, claims and abstract, is incorporated herein by reference in its entirety.

BACKGROUND OF THE INVENTION

The present invention relates to a percussion instrument striking detection device and, in particular embodiments, to a percussion instrument striking detection device configured to reduce the time from when a head is struck until the vibrations of the head are detected. In those or additional embodiments, a percussion instrument striking detection device is further configured to reliably detect vibrations that are in conformance with the striking force, without regard to the condition of the head.

PRIOR ART

For some time, methods have been known to amplify the musical tone that is generated by the performance of an acoustic drum, where such known methods increase the sound volume or convert the timbre of the musical tone into an electronic sound. In those methods, the vibration of the head that is produced at the time that the acoustic drum is struck is detected by a percussion instrument striking detection device that has a sensor. Then, a musical tone is generated in conformance with the preferences of the performer, by converting the detected vibration waveform into an electronic signal.

A percussion instrument striking detection device such as that described above is, for example, disclosed in U.S. Pat. No. 6,794,569. The percussion instrument striking detection device is provided with a main body section 12 and a sensor 16 (a vibration sensor). The main body section 12 is mounted on the rim 32 of a snare drum 30 (a percussion instrument). The sensor 16 is held on the main body section 12, via an arm 14 and is arranged to contact a portion of the drum head 34. Then, when the drum head 34 is struck, the vibrations of the drum head 34 are detected by the sensor 16.

If the sensor 16 is mounted in the striking position of the drum head 34 (the center portion of the drum head 34), the distance between the striking location and the mounting position of the sensor 16 may be relatively short. Accordingly, there can be a large difference in the vibrations that the sensor 16 detects between those cases in which the striking location has coincided with the mounting position of the sensor 16 and those cases where the striking location is separated from the position of the sensor by a greater amount. In that percussion instrument striking detection device, the sensor 16 detects the vibrations of the peripheral portion of the drum head 34. Because the sensor 16 is mounted in a position that is likely separated from the striking location, even if the striking location is distant from the center position of the drum head 34, it is possible to minimize differences in the vibrations that are detected by the sensor 16.

However, in such devices where vibrations are detected at the peripheral portion of the drum head 34, there can be a significant time lag between the time at which the drum head 34 is struck and the time at which vibrations of the drum head 34 are detected. As a result, the performer may have an uncomfortable feeling relating to the time lag from the striking of the drum head 34 until the musical tone has been produced. In addition, even if the striking force is uniform, the vibrations of the drum head 34 are affected by the tension and the material of the drum head 34. Accordingly, it may not be possible for some devices to reliably detect the vibrations in conformance with the striking force. Because the waveforms of the vibrations of the drum head 34 differ depending on the tension of the drum head 34, tension adjustments of the drum head 34 may need to be carried out in order to generate the desired musical tone. In addition, because the drum head can be a relatively large membrane surface, sympathetic vibrations are likely to occur. That is, the sensor may detect head vibrations that are due to the musical tones that are produced by other musical instruments. In addition, in those cases where the drum head 34 is configured with a material such as rubber and the like, the head vibrations can be relatively difficult to detect.

SUMMARY OF THE INVENTION

Embodiments of the present invention relate to a percussion instrument striking detection device configured to reduce the time from when a head is struck until the vibrations of the head are detected. In those or additional embodiments, a percussion instrument striking detection device is further configured to reliably detect vibrations that are in conformance with the striking force, without regard to the condition of the head.

A percussion instrument striking detection device according to an embodiment of the present invention is provided with a shaft member and a striking member. The shaft member is formed in a shaft shape. The striking member has a hollow interior and is attached to one end of the shaft member. In addition, the striking member is provided with a vibration sensor that detects vibrations. As a result, vibrations of the striking member that are produced at the time that the head of the percussion instrument is struck can be detected by the vibration sensor that is inside of the striking member. Therefore, it is possible to make the distance between the vibration sensor and the striking location on the head by the striking member to be relatively short. Accordingly, the time period from when the head is struck to the detection of the vibrations by the vibration sensor can be made relatively short, compared to the case in which the head vibrations are detected at a peripheral portion of the head, distant from the striking location. As a result, the time period from the striking of the head until the generation of the musical tone is minimized and a more realistic and comfortable feeling can be experienced by the performer. In addition, because the vibration sensor detects vibrations of the striking member, it is possible to prevent the occurrence of variations in the detected vibrations in the event that the location at which the head is struck changes because the installed position of the foot pedal has shifted.

In addition, because the vibration sensor detects vibrations of the striking member that strikes the head, it is possible to suppress the effects of the tension and material of the head on the vibrations that the vibration sensor detects. Therefore, vibrations can be reliably detected in conformance with the striking force. In addition, the vibration sensor is attached to the striking member, which can be configured to have a much smaller surface area compared to the head. Accordingly, it is possible to minimize or avoid vibrations of the striking member due to musical tones that are produced by other musical instruments. Therefore, unwanted detection by the vibration sensor of those striking member vibrations can be suppressed. In addition, vibrations of the striking member can be detected, even in cases where the head is configured by a material such as rubber and the like. Therefore, percussion instrument striking detection devices according to various embodiments of the present invention can be configured for versatility and use in a broad variety of applications.

As discussed above, a percussion instrument striking detection device according to embodiments of the present invention is configured with a shaft-shaped shaft member and a striking member that is attached to the end of the shaft member, where the striking member has a vibration sensor. Accordingly, it is possible to exchange a member (a beater) that is mounted on the foot pedal of an acoustic bass drum and compatible with a shaft member and a striking member of an embodiment of the present invention, with the shaft member and the striking member. In other words, a percussion instrument striking detection device according to an embodiment of the present invention may be mounted on the foot pedal for an acoustic bass drum.

Because the striking of the head is linked to the treading action of the foot pedal being stepped on, the striking force can be relatively great as compared to the force when a drum head is struck by a drum stick held in a performer's hand. Accordingly, there can be a danger of damage to the vibration sensor during the performance. Therefore, certain embodiments of the present invention include an elastic member that is made from an elastic material, attached inside the striking member, and configured to hold the vibration sensor. As a result, the elastic member can moderate the force of the impact that is transmitted to the vibration sensor from the striking member. Accordingly, damage to the vibration sensor due to the force of the impact when the striking member strikes the heads can be minimized or avoided.

In addition, for embodiments in which the vibration sensor is held by an elastic member configured from an elastic material, it is possible to adjust the resonance frequency of the vibration sensor by selecting or changing the degree of hardness and the shape of the elastic material. Accordingly, it is possible for the elastic member to be configured to amplify the vibrations of the vibration sensor when struck with a relatively small striking force, while dampening external vibrations generated by other vibration generation sources and, for example, transmitted to the foot pedal via the floor, or vibrations that are generated when the operator simply places his or her foot on the foot pedal without operating the pedal to strike the head. Therefore, it is possible to limit erroneous detection by the vibration sensor due to externally caused vibrations of the striking member during a performance, while the vibrations of the striking member due to a striking action are reliably detected by the vibration sensor.

In an example of a percussion instrument striking detection device according to the embodiments described above, the striking member is provided with a sheet form plate that is held in the elastic member and is configured with a material that is stiffer than the elastic material of the elastic member. The vibration sensor is held on the elastic material via the plate and, thus, can be supported for resilience from the impact of the striking member. In this regard, the vibration sensor may include precision components, yet be protected against damage when the striking member is subjected to impact. Accordingly, by attaching the vibration sensor to the plate on the elastic member, the vibration sensor is provided with further resilience and the vibration sensor is provided with a level of protection against damage.

In addition, in embodiments in which the vibration sensor is held in the elastic member via a plate that is stiffer than the elastic member, it is possible to make it unlikely that the vibration sensor will be affected by the shape, dimensions or manner of attachment of the elastic member. In other embodiments where the vibration sensor is held directly in the elastic member, the output of the vibration sensor can be significantly affected by the dimensions of the elastic member that holds the vibration sensor. Accordingly, in embodiments in which the vibration sensor is held in the elastic member indirectly, via the plate or the like, it is possible for vibration detection to be carried out reliably, without being affected by certain conditions of the elastic member.

In a further example of a percussion instrument striking detection device according to the embodiment described above, the plate is held by the elastic member, uniformly around the circumferential direction on a peripheral portion of the plate. Therefore, it is possible to limit the direction that the vibration sensor is likely to vibrate while held on the plate. In other embodiments where the plate is not held by the elastic member uniformly in the circumferential direction, the plate and the vibration sensor may vibrate in multiple directions with respect to the direction of the striking, and the output of the vibration sensor can be unstable. In contrast to this, in embodiments in which the plate is held by the elastic member uniformly around its circumferential direction, it is possible to limit the vibration of the plate and the vibration sensor to one of the directions that they are likely to vibrate when a striking action takes place (for example, the direction that is perpendicular to the head that is struck by the striking member). Therefore, vibrations of the striking member can be detected more reliably by the vibration sensor.

In a further example of a percussion instrument striking detection device according to any of the embodiments described above, the striking member is provided with a striking surface formed on its outer surface, which hits and comes into contact with the head when the head is struck by the striking member. In addition, the vibration sensor is provided with a suitable sensing element, such as, but not limited to a piezoelectric element, such as a plate form piezoelectric element. In such embodiments, the piezoelectric element may be arranged at a desired orientation, for example, to face the striking surface and at an angle of inclination of 30° or less with respect to the striking surface. Accordingly, vibrations of the striking member that are produced at the time that the head is struck can be reliably transmitted to the vibration sensor. In particular, when the head is struck by the striking member, the striking member tends to vibrate in the direction that is perpendicular to the striking surface of the striking member. Accordingly, in embodiments where the angle of inclination of the piezoelectric element with respect to the striking surface is greater than 30°, vibrations of the striking member may be less reliably transmitted to the piezoelectric element. In contrast, in embodiments in which the angle of inclination of the piezoelectric element is 30° or less with respect to the striking surface, it is possible for the vibrations of the striking member to be more reliably transmitted to the piezoelectric element. Therefore, embodiments of the invention are configured to more reliably detect vibrations of the striking member.

In addition, if the piezoelectric element is attached to a plate at an angle of inclination with respect to the striking surface of greater than 30°, an inertial force is produced when the head is struck, where the inertial force has a greater force component in the shear direction (the direction that is parallel to the piezoelectric element and plate attachment surfaces) that operates on the piezoelectric element. As a result, the piezoelectric element can be more likely to separate from the plate. In contrast, in embodiments in which the angle of inclination of the piezoelectric element with respect to the striking surface is 30° or less, the force component in the shear direction that acts on the piezoelectric element when the head is struck by the striking member can be minimized. Therefore, embodiments of the invention are configured to inhibit the separation of the piezoelectric element from the plate.

In a further example of a percussion instrument striking detection device according to the embodiments described above, the piezoelectric element is arranged parallel to the striking surface, such that vibrations of the striking member can be more efficiently transmitted to the piezoelectric element. The piezoelectric element may be configured to easily bend in conformance with the vibrations of the striking member, so that vibrations of the striking member can be more reliably detected. In addition, in embodiments where the piezoelectric element is attached to a plate, the device may be configured such that the inertial force of the striking member that is produced at the time of the striking of the head by the striking member acts in the direction that is perpendicular to the surface direction of the piezoelectric element. Accordingly, it is possible to minimize or prevent the force component from acting in the shear direction of the piezoelectric element. Therefore, separation of the piezoelectric element from the plate can be reliably prevented.

In a further example of a percussion instrument striking detection device according to any of the embodiments described above, the striking member includes a first striking member that is fixed to the shaft member and a second striking member that is mounted on the first striking member in a manner so that the second striking member can be freely attached and detached from the first striking member. In addition, at least one of the first striking member or the second striking member is configured to have a hollow interior. The vibration sensor is accommodated inside either one of the first striking member and the second striking member. Therefore, if the vibration sensor has been damaged, the vibration sensor can be changed by exchanging the one of the first striking member or the second striking member that accommodates the vibration sensor. Because the vibration sensor may include precision components that can be damaged if the worker doing the exchanging recklessly handles the vibration sensor, an example embodiment of the invention is configured such that it is possible to change the vibration sensor without directly touching the vibration sensor. Accordingly, damage to the vibration sensor when exchanging the vibration sensor can be prevented and an exchanging procedure can be carried out efficiently.

In addition, in the event that the vibration sensor has been damaged, only the one of the first striking member or the second striking member that contains the vibration sensor need be exchanged. Therefore, the cost of replacing a vibration sensor can be reduced as compared to embodiments in which the entire striking member is changed.

In a further example of a percussion instrument striking detection device according to any of the embodiments described above, the vibration sensor is configured to be held by the elastic member in a manner so that the sensor can be freely attached and detached from the elastic member. Accordingly, in the event that the vibration sensor has been damaged, it is possible to detach the vibration sensor from the elastic member and exchange it for a new vibration sensor. Therefore, the cost of replacing a vibration sensor can be reduced as compared to embodiments in which the entire striking member is changed.

In a further example of a percussion instrument striking detection device according to any of the embodiments described above, the percussion instrument striking detection device is provided with a cable and, in yet further embodiments, is also provided with a fixing piece. The cable electrically connects the vibration sensor to a sound source apparatus. The fixing piece fixes the cable to the shaft member. By fixing the cable to the shaft member by the fixing piece, it is possible to prevent the cable from becoming tangled around the shaft member or the foot pedal when the percussion instrument is performed. The striking member is operably linked to the foot pedal to move in a pivotal or rotary fashion by the operation of stepping on the foot pedal, and the cable that is connected to the vibration sensor that is inside of the striking member also moves with the pivotal or rotational motion of the striking member. As a result, in embodiments where the movement of the cable is not restricted, the cable can easily become tangled around the shaft member or the foot pedal during a performance, and this may lead to interference with the performance or breaking of the cable. In contrast, in embodiments in which the cable is fixed to the shaft member by the fixing piece, it is possible to restrict the movement of the cable. Therefore, embodiments of the invention may be configured to prevent the cable from interfering with a performance and to prevent the cable from breaking

BRIEF DESCRIPTION OF THE DRAWINGS

FIG. 2(*b*) is a side view of the beater of the first embodiment;

FIG. 3(*a*) is a cross section view of the beater of the first embodiment, taken along the line IIIa-IIIa of FIG. 2(*b*);

FIG. 3(*b*) is a cross section view of the beater of the first embodiment, taken along the line IIIb-IIIb of FIG. 2(*a*);

FIG. 4(*b*) is exploded perspective view of the beater of the first embodiment.

DETAILED DESCRIPTION OF THE PREFERRED EMBODIMENTS

Figure 1:
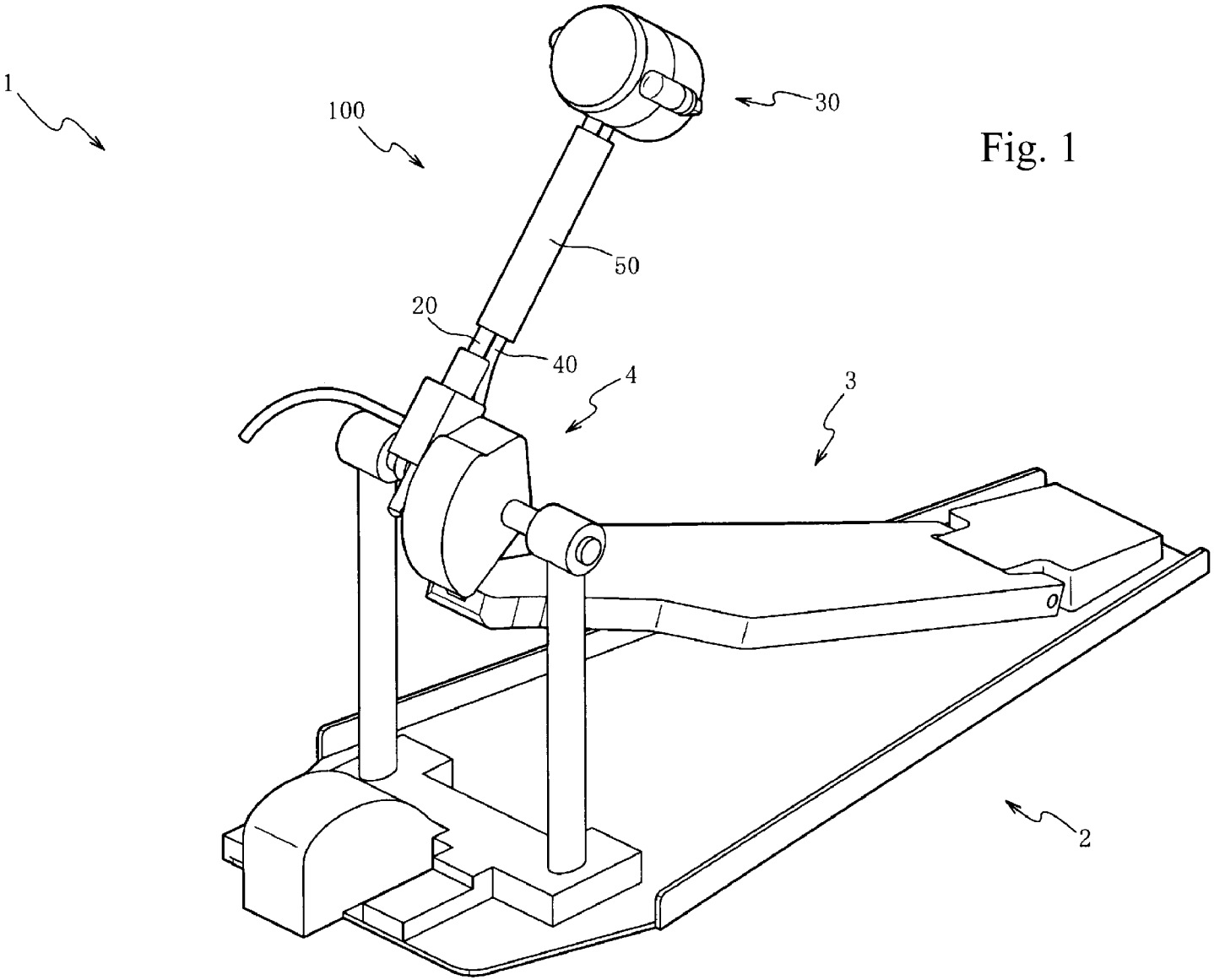
FIG. 1 is a perspective view of a foot pedal on which a beater of a first embodiment of the present invention is mounted.
Figure 2A:
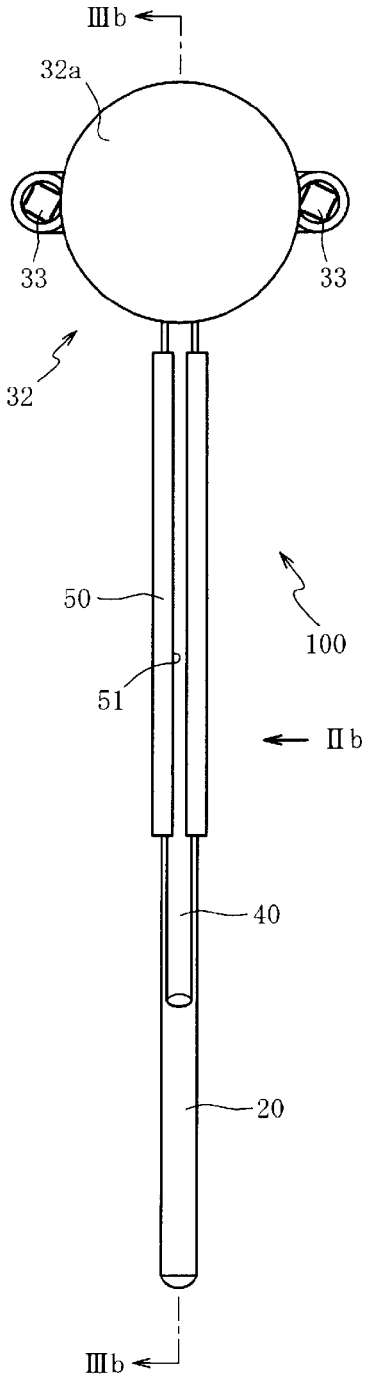
FIG. 2(*a*) is a rear view of the beater of the first embodiment.
Figure 2B:
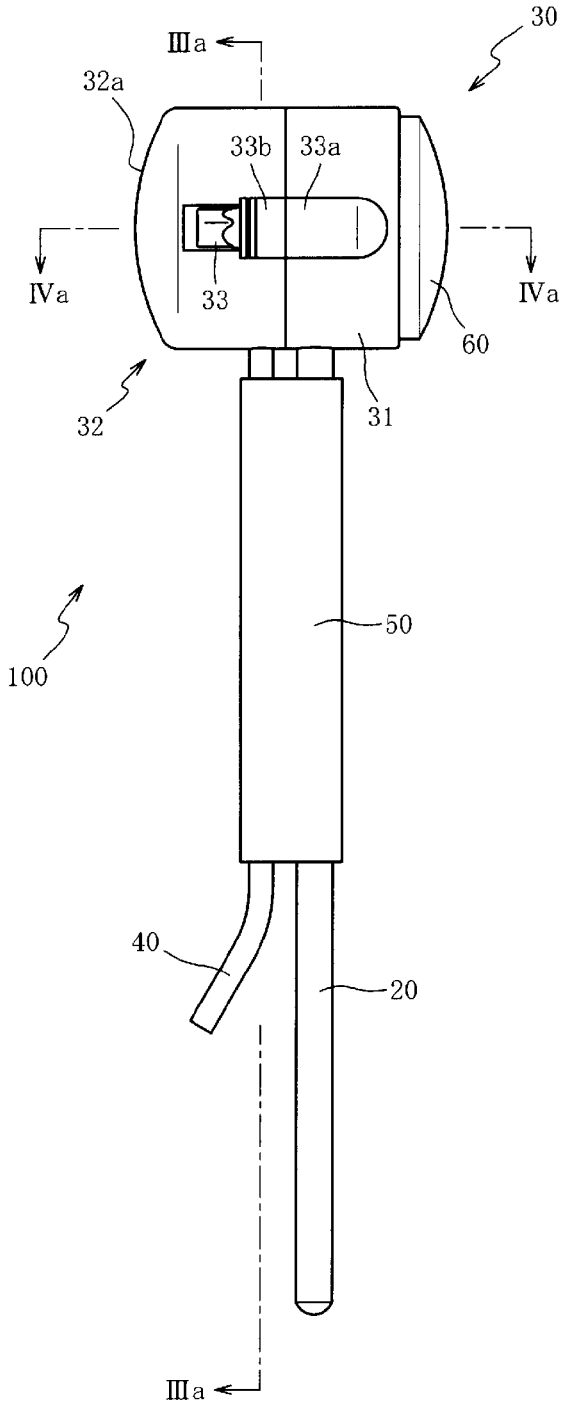

An explanation will be given below regarding example embodiments of the present invention while referring to the attached drawings. First, an explanation will be given regarding the configuration of the beater 100 while referring to FIG. 1 and FIG. 2. FIG. 1 is a perspective view drawing of a foot pedal on which the beater 100 of a first embodiment of the present invention has been mounted. FIG. 2(*a*) is a rear view drawing of the beater 100 and FIG. 2(*b*) is a side view drawing of the beater 100. The foot pedal in FIG. 1 further includes a mechanism (a spring or the like) for returning the foot board 3 to the original position after it has been stepped on, but that mechanism is not shown, to simplify the drawing.

The foot pedal 1 in FIG. 1 may be arranged to strike the head (not shown in the drawing) of a bass drum (not shown in the drawing), at the time of a performance of the bass drum, in conformance with the treading of the foot of the performer on the foot pedal 1. The foot pedal 1 is provided with a frame 2, a foot board 3, a rotating member 4, and a beater 100. The frame 2 is configured to be placed on the floor or other suitable flat surface. The foot board 3 is mounted on the frame 2 so that the foot board can pivot and swing freely. The rotating member 4 is supported on the frame 2 by a shaft and is operatively linked to the foot board, so that the rotating member 4 rotates with the pivotal or swinging motion of the foot board 3. The beater 100 is supported on the rotating member 4 and is configured to be selectively attached and detached from the rotating member 4. When a bass drum performer steps with a foot on the foot board 3, the beater 100 on the rotating member 4, moves with the motion of the foot board 3 and strikes the head of the bass drum.

As is shown in FIG. 2(*a*) or 2(*b*), the beater 100 is configured to strike the head of the bass drum and detect the fact that the head of the drum has been struck. The beater 100 is provided with a shaft member 20, a striking member 30, a cable 40, and a fixing piece 50. The shaft member 20 is supported on the rotating member 4 of the foot pedal 1 (refer to FIG. 1). The striking member 30 is attached to one end of the shaft member 20. The cable 40 electrically connects the striking member 30 to a sound source apparatus (not shown in the drawing). The fixing piece 50 fixes the cable 40 to the shaft member 20.

The shaft member 20 is formed in a shaft shape and operatively links the striking member 30 and the rotating member 4 of the foot pedal 1. In addition, the shaft member 20 is supported and operatively linked to pivotally rotate, to move the striking member 30, in response to the treading operation of the foot board 3 of the foot pedal 1 (refer to FIG. 1).

The striking member 30 is a cylindrically shaped component that is configured to be arranged to impact the head at the time of the performance of the bass drum. The striking member 30 is provided with a first striking member 31, a second striking member 32, and bolts 33 or other suitable connecting mechanism. The first striking member 31 is attached to the shaft member 20. The second striking member 32 is mounted on the first striking member 31, and is selectively attachable to and detachable from the first striking member. The bolts 33 connect the first striking member 31 and the second striking member 32 together.

The first striking member 31 is configured of any suitable material and, in an example embodiment is configured primarily with resin. The first striking member 31 has a first striking surface 31*a*, two female threaded sections 33*a*, and a contacting member 60. The first striking surface 31*a* (refer to FIG. 3(*b*)) is a flat outer surface portion on the side of the first striking member 31 that is opposite to the side on which the second striking member 32 is mounted (the right side in FIG. 2(*b*)). The female threaded sections 33*a* are formed as portions of the first striking member 31 that protrude outward in a direction perpendicular to the first striking surface 31*a*. The bolts 33 are screwed into the female threaded sections 33*a*. The contacting member 60 is configured with any suitable material, for example, a relatively soft material such as felt, and is attached to the first striking surface 31*a*. In addition, the second striking member 32 is provided with a main body section 34 that is configured of any suitable material, for example a relatively hard material such as primarily resin (refer to FIG. 3(*b*)). The main body section 34 is provided with a second striking surface 32*a* and bolt insertion sections 33*b*. The second striking surface 32*a* is formed in a hemispherical shape, on the outer surface of the side of the striking member 30 that is opposite to the side on which the first striking member 31 is mounted (the left side in FIG. 2(*b*)). The bolt insertion sections 33*b* are formed as portions of the main body section 34 that protrude outward in a direction to correspond in position to the female threaded sections 33*a*, to allow the bolts to be inserted through the bolt insertion sections 33*b* and engage the female threaded sections 33*a*. Either of the contacting member 60 or the second striking surface 32*a* may be arranged to hit and come into contact with the head of a bass drum when the bass drum is performed. In those cases where the performer uses the beater 100 as a conventional beater that strikes an acoustic bass drum, it is possible to select either the contacting member 60, which is configured with a soft material, such as felt, or the second striking surface 32*a*, which is configured with a harder material, such as resin, as the surface that hits and contacts the head. Accordingly, a performer can set the musical tone that is produced by the striking sound at the time that the head is struck to conform with his or her preferences.

The fixing piece 50 is fastened to the shaft member 20 and is configured to restrict the movement of the cable 40 at the time that the shaft member 20 and the striking member 30 pivotally rotate. The fixing piece 50 is provided with a groove form fitting section 51 that is formed with one side opened, such that the cable 40 can be fit into the fitting section 51. By fitting the cable 40 into the fitting section 51, it is possible to prevent the cable 40 from becoming tangled with the shaft member 20 or the foot pedal 1 (refer to FIG. 1) when the percussion instrument is performed. More specifically, because the striking member 30 pivotally rotates with the treading operation of the foot board 3 of the foot pedal 1 (refer to FIG. 1), the cable 40 that extends into the striking member 30, also moves with the rotational movement of the striking member 30. If the cable 40 is not restricted, the cable 40 can interfere with the performance or break. However, because the cable 40 is fit into the fitting section 51 of the fixing piece 50, which is fastened to the shaft member 20, it is possible to restrict the movement of the cable 40. Therefore, conditions in which the cable 40 would interfere with the performance or break can be prevented.

Figure 4:
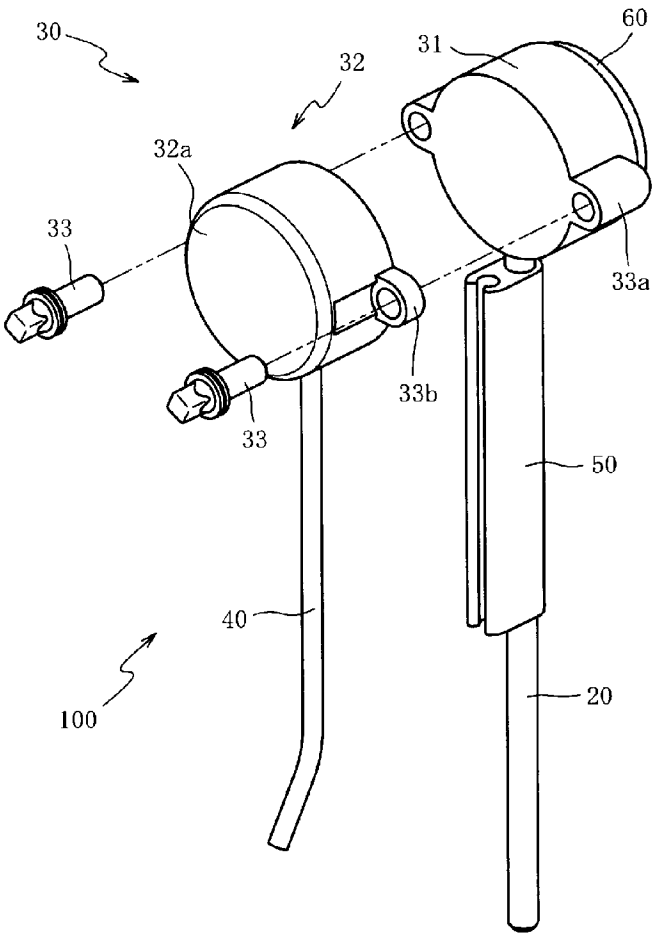
FIG. 4(*a*) is a cross section view of the beater of the first embodiment, taken along the line IVa-IVa of FIG. 2(*b*)
Figure 4:
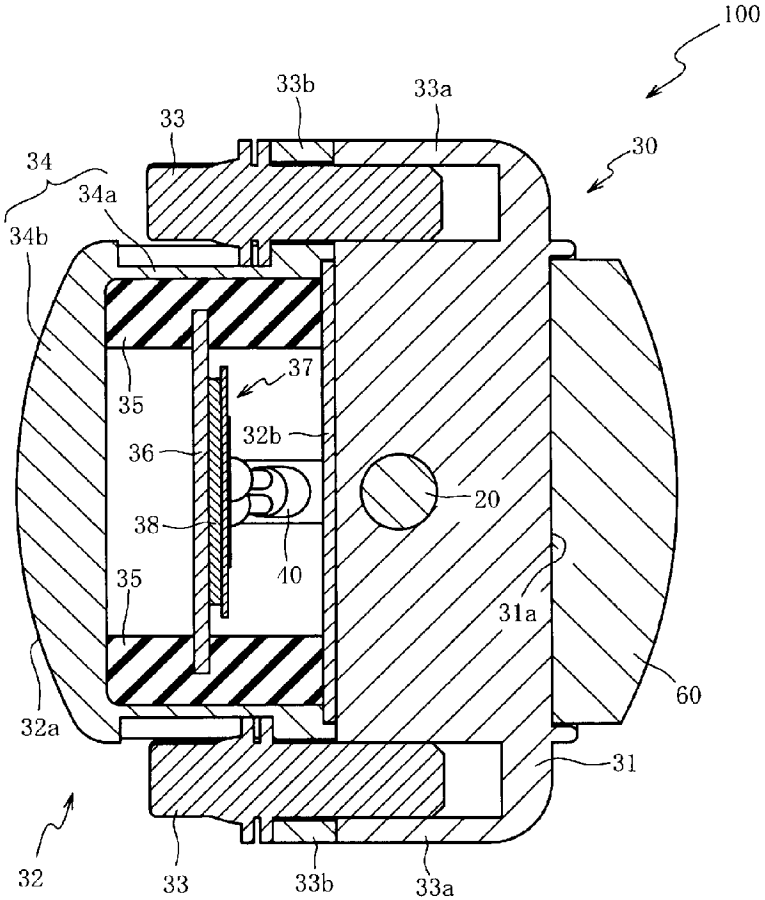

An example embodiment of the second striking member 32 is described while referring to FIG. 3 and FIG. 4. FIG. 3(*a*) is a cross section view drawing of the beater 100 along the line IIIa-IIIa of FIG. 2(*b*), and FIG. 3(*b*) is a cross section view drawing of the beater 100 along the line IIIb-IIIb of FIG. 2(*a*). FIG. 4(*a*) is a cross section view drawing of the beater 100 along the line IVa-IVa of FIG. 2(*b*), and FIG. 4(*b*) is an exploded perspective view of the beater 100. In FIG. 3(*a*) and FIG. 3(*b*), in order to simplify the drawing and explanation, the cable 40 has been shown without a cross section view.

As shown in FIG. 3(*a*) or FIG. 3(*b*), the second striking member 32 is provided with the main body section 34, an elastic member 35, a plate 36, and a vibration sensor 37. The main body section 34 is provided as the outer portion of the second striking member 32. The elastic member 35 is attached to the main body 34, within a hollow volume located inside of the main body 34. The plate 36 is attached to and held on the elastic member 35. The vibration sensor is attached to and held on the plate 36.

The main body 34 is configured as a cylindrical shaped member that is opened on one end (the end on the right side of FIG. 3(*b*)). The main body 34 has a cylindrically shaped side wall section 34*a* and an end section 34*b*. The end section 34*b* closes the second end of the cylindrically shaped side wall section 34*a* (the end on the left side of FIG. 3(*b*)). The second striking surface 32*a* is formed as the outer surface side of the end section 34*b* (on the left side in FIG. 3(*b*)). In addition, a plate-shaped occluding member 32*b* is arranged to close the opening on the one end (the end on the right side in FIG. 3(*b*)) of the main body 34, to seal the hollow interior volume of the main body 34. A cable 40 is inserted into the hollow interior volume of the main body 34, through an insertion hole 34*c* in a side wall section 34*a* of the main body 34.

The elastic member 35 is configured to dampen vibrations and impact forces that are transmitted to the vibration sensor 37 from the main body 34 when the head of the bass drum is struck. In an example embodiment, the elastic member 35 is formed in a cylindrical shape from an elastic material. The outer peripheral surface of the elastic member 35 is attached to the inner peripheral surface of the main body 34. The diameter of the inner peripheral surface of the elastic member 35 is formed smaller than the outer diameter of the plate 36. Also, an insertion hole 35*a* is provided through the elastic member 35 for the cable 40 to extend through the elastic member 35. The insertion hole 35*a* is formed in a position that corresponds to and aligns with the main body insertion hole 34*c* that is formed in the side wall 34*a* of the main body 34. The elastic member 35 may be made of any suitable material having cushioning properties, including materials that are softer than the material of the main body section 34, such as, but not limited to rubber, sponge, or the like.

The plate 36 is configured to maintaining the vibration sensor 37 resilient with respect to the impact force on the main body section 34 that is produced when the head of the bass drum is struck by the striking member 30. The plate 36 is configured of a suitable material and shape, such as a metal and a disk shape. The plate 36 is arranged at the inner peripheral surface of the elastic member 35. In addition, the whole peripheral portion of the plate 36 is held by the inner peripheral surface of the elastic member 35. The plate 36 is arranged parallel to the first striking surface 31*a* of the first striking member 31. In addition, the plate 36 is arranged parallel to the end section 34*b* of the second striking member 32. The plate 36 is configured with a material that has a greater degree of stiffness than the elastic member 35 and the metal plate 37*b*, which will be discussed later.

The vibration sensor 37 is configured to detect vibrations of the main body section 34. The vibration sensor 37 is provided with the piezoelectric element 37*a* and the metal plate 37*b* that is adhered and fixed to one surface of the piezoelectric element 37*a*. The piezoelectric element 37*a* is a disk-shaped member that detects vibrations by repeatedly bending in the direction that is perpendicular to the direction of the thickness, when vibrated. The piezoelectric element 37*a* is configured from piezoelectric ceramic. The metal plate 37*b* is a disk-shaped member that is configured from a suitable metal and is formed with an outside diameter that is larger than that of the piezoelectric element 37*a*. In addition, the metal plate 37*b* is adhered to the plate 36 and is arranged parallel to the plate 36. Since the plate 36 is arranged parallel to the first striking surface 31*a* and the end section 34*b*, the piezoelectric element 37*a* and the metal plate 37*b* are arranged parallel to the first striking surface 31*a* and the end section 34*b*. In example embodiments, the metal plate 37*b* is configured with a material that bends relatively easily due to the vibrations of the main body section 34, including, but not limited to, for example, brass, tombac, nickel, or the like.

The metal plate 37*b* may be adhered to the plate 36 by any suitable mechanism, including, but not limited to a double-sided tape 38. For example, a piece of double sided tape 38 is formed with an outside diameter that is smaller than that of the metal plate 37*b*, and is adhered only in a center portion of the metal plate 37*b*. Accordingly, since a peripheral edge portion of the metal plate 37*b* is not adhered to the double-sided tape, the metal plate 37*b* is easily bent by the vibrations of the main body section 34, such that vibrations of the main body section 34 may be transmitted to the piezoelectric element 37*a*.

The cable 40 is inserted through insertion holes 34*c* and 35*a*, to the inside of the elastic member 35. In addition, one end of the cable 40 is electrically connected to the vibration sensor 37.

A method of detection for the striking of the bass drum by the beater 100 is described, as follows. When the head is struck by the striking member 30 by hitting the head of the bass drum with either the first striking surface 31*a* or the second striking surface 32*a*, vibrations are transmitted to the vibration sensor 37 via the plate 36 that is held on the elastic member 35. The piezoelectric element 37*a* bends in conformance with the vibrations and, as a result, produces a detectable electrical signal corresponding to the vibrations. As a result, a vibration waveform detected by the vibration sensor 37 is converted into an electrical signal and provided to a sound source apparatus (not shown) for producing a musical tone in conformance with the preferences of the performer.

Because the second striking member 32 of the striking member 30 is provided with the vibration sensor 37, the vibrations of the striking member 30 that are produced when the head of the bass drum is struck can be detected by the vibration sensor 37. Therefore, it is possible to make the distance from the location at which the striking member 30 strikes the head to the location of the vibration sensor 37 to be relatively short. Accordingly, compared to a case in which the vibrations are detected at a peripheral portion of the head, distant from the striking location, the time lag from the striking of the head until the detection of the strike vibrations by the vibration sensor 37 can be made relatively small. As a result, it is possible for the time from the striking of the head until the generation of the musical tone to be shortened to minimize or avoid a sensation or feeling by the performer of unease. In addition, since the vibration sensor 37 detects the vibrations of the striking member 30, it is possible to prevent the occurrence of variations in the vibrations in the event that the location at which the head is struck changes due to the shifting of the set position of the foot pedal 1 (refer to FIG. 1).

In addition, because the vibration sensor 37 detects the vibrations of the striking member 30 that strikes the head, the effects on the detected vibrations due to head tension or head material can be minimized. Therefore, it is possible to reliably detect vibrations in conformance with the striking force. In addition, because the vibration sensor 37 is attached to the striking member 30, and because the striking member 30 has a relatively small surface profile area compared to the head, the vibration of the striking member 30 due to the musical tones that are produced by other musical instruments can be minimized. Therefore, it is possible to suppress the detection by the vibration sensor 37 of the vibrations of the striking member 30 caused by musical tones that are produced by other musical instruments. In addition, because the vibrations of the striking member 30 can be detected even in those cases where the head is configured by a material such as rubber and the like, embodiments of the invention can be versatile and employed in a relatively broad range of applications of use.

In addition, because the beater 100 includes the striking member 30 attached to the end of the shaft member 20 and having the vibration sensor 37, the beater 100 can be readily exchanged with a beater that is mounted on a foot pedal used for an acoustic bass drum. In this manner, the beater 100 may be readily mounted on the foot pedal for an acoustic bass drum, to replace the standard acoustic beater that may have been provided with the foot pedal.

When the foot board 3 of the foot pedal 1 (refer to FIG. 1) is stepped on with a foot, the striking member 30, which is operatively linked to the pedal, strikes the head. Compared to a member such as a drum stick and the like that strikes the head using a hand, the force of the impact at the time of striking with the striking member 30 can be relatively great, such that it may be desirable to protect the vibration sensor against damage during a performance. Because the vibration sensor 37 of the beater 100 is attached to the plate 36, and the plate 36 is held by the elastic member 35, the elastic member 35 is able to dampen the force of the impact that is transmitted to the vibration sensor 37 from the main body section 34. Accordingly, the vibration sensor 37 can be protected against damage from the force of the impact at the time of the striking of the head by the striking member 30.

In addition, because the vibration sensor is held by the elastic member 35 via the plate 36 that has a higher degree of stiffness than the elastic member 35, the vibration sensor 37 can have sufficient resilience with regard to the impact of the main body section 34. Embodiments of the vibration sensor may include precision components that can become deformed or damaged, if not sufficiently protected against impact forces. In addition, embodiments of the piezoelectric element 37*a* and the metal plate 37*b* are configured with materials that are easily bent. Therefore, by attaching the vibration sensor 37 to the plate 36, it is possible to for the vibration sensor 37 to have sufficient resilience, yet also avoid or minimize deformation of and damage to the vibration sensor 37 from impact forces.

Since the vibration sensor 37 is held by the elastic member 35, it is possible to adjust the resonant frequency of the vibration sensor by selecting or changing the hardness or shape of the elastic member 35. As a result, while amplifying the vibrations of the vibration sensor 37 when a drum head is struck with a small striking force, external vibrations can be dampened by the elastic member 35, including external vibrations that are generated by other sources and transmitted to the foot pedal 1, for example, via the floor, and vibrations that are generated when the performer simply puts his or her foot on the foot pedal 1 without an operation that strikes the head. Therefore, it is possible to minimize erroneous detections by the vibration sensor 37 of vibrations of the main body section 34 from external sources during a performance, while reliably detecting the vibrations of the main body section 34 by the vibration sensor 37 due to the striking of a drum head.

In addition, because the vibration sensor 37 is held by the elastic member 35 via the plate 36, which has a higher degree of stiffness than the elastic material, it is less likely that the vibration sensor 37 will be affected by the manner in which the vibration sensor 37 is held by the elastic member 35. In alternative embodiments where the vibration sensor 37 is held directly on the elastic member 35, the output of the vibration sensor 37 may be greatly affected by the dimensions of the elastic member 35 that holds the vibration sensor. In contrast, in embodiments in which the vibration sensor 37 is held by the elastic member 35 indirectly, via the plate 36, it is possible for the detection to be stable and less affected by the manner in which the vibration sensor 37 is held relative to the elastic member 35.

In example embodiments, the plate 36 is connected to the elastic member around the entire peripheral portion of the plate 36. Therefore, it is possible to limit the direction that the vibration sensor 37 on the plate 36 is likely to vibrate. In alternative embodiments where the plate 36 is held by the elastic member 35 in a manner that is not uniform in the circumferential direction of the plate such that the vibration sensor 37 may vibrate in a multiple number of directions with respect to the direction of the striking, the output of the vibration sensor 37 can be less stable. In contrast, in embodiments in which the entire peripheral portion of the plate 36 is held by the elastic member 35, it is possible to limit the vibration of the plate 36 and the vibration sensor 37 to one of the directions that they are likely to vibrate when the striking member 32 strikes a drum head (e.g., the direction that is perpendicular to the head that is struck by the striking member 30 and the direction that is perpendicular to the first striking surface 31*a* and the second striking surface 32*a* in FIG. 3(*b*)). Therefore, the vibrations of the striking member 30 at the time of striking a drum head can be reliably detected by the vibration sensor 37. In addition, since the entire peripheral portion of the plate 36 is held by the elastic member 35, undesired vibrations of the plate 36 due to residual or other vibrations of the main body section 34 can be attenuated. Accordingly, an erroneous detection by the vibration sensor 37 of residual vibrations of the plate 36 that continue after the head has been struck by striking member 30 can be avoided.

Moreover, the plate 36, the piezoelectric element 37*a*, and the metal plate 37*b* are arranged parallel to the first striking surface 31*a* and the end section 34*b*. In that arrangement, the plate 36, the piezoelectric element 37*a*, and the metal plate 37*b* are more likely to be vibrated in relation to the vibrations of the striking member 30 produced when the head is struck in the direction that is perpendicular to the striking surface 31*a* and the end section 34*b*. Therefore, the vibrations of the main body section 34 can be efficiently transmitted to the piezoelectric element 37*a*.

In addition, because the inertial force of the striking member 30 that is produced at the time that the head is struck by the striking member 30 acts in the direction that is perpendicular to the surface direction of the piezoelectric element 37*a* and the metal plate 37*b*, it is possible to prevent or minimize action by the force component in the shear direction of the piezoelectric element 37*a* and the metal plate 37*b* (the direction that is parallel to the attachment surface of the piezoelectric element and the plate). Therefore, separation of the piezoelectric element 37*a* and the metal plate 37*b* from the plate 36 can be prevented.

A method of mounting the first striking member 31 and the second striking member 32 is described with reference to FIGS. 4(*a*) and 4(*b*). As shown in FIG. 4(*a*) and FIG. 4(*b*), the second striking member 32 is mounted on first striking member 31, by inserting bolts 33 through the bolt insertion section 33*b* of the second striking member 32, and screwing the bolts 33 into the female threaded section 33*a* of the first striking member 31. As a result, the second striking member 32 is mounted on the first striking member 31 such that the position at which the shaft member 20 protrudes and the position of the main body section insertion hole 34*c* in the side wall section 34*a* of the main body section 34 (refer to FIG. 3(*b*)) coincide, for example, by being positioned adjacent each other on the same side (the bottom side in FIG. 3(*b*)) of the striking member 30.

Also, because the opening on one end of the second striking member 32 is closed by the occluding member 32*b*, the hollow interior volume of the second striking member 32 is sealed with the vibration sensor 37 attached to the second striking member 32, inside the hollow interior volume of the second striking member 32. Therefore, it is possible to change the vibration sensor 37, for example, in the event that the vibration sensor 37 has been damaged, by exchanging and replacing the second striking member 32. The vibration sensor 37 can include precision components. Accordingly, it is possible to avoid damaging the vibration sensor due to reckless handling of the vibration sensor 37, because the vibration sensor 37 is attached and sealed on the inside of the second striking member 32 and, thus, need not be directly touched during a replacement operation. Accordingly, damage to the vibration sensor 37 when exchanging and replacing the vibration sensor 37 can be prevented, and the operation of exchanging and replacing the vibration sensor can be carried out efficiently.

A beater 200 according to a second embodiment of the present invention is described with reference to FIG. 5. In embodiments as described above, the entire peripheral portion of the plate 36 is held by the elastic member 35. In contrast, in the second embodiment, a portion of the entire periphery, but less than the entire periphery of the plate 36 is held by the elastic member 35. Other features of the above-described embodiments may be included in second embodiment and the same reference characters are used for corresponding features among and between those embodiments. Reference is made to the above descriptions of those features. For example, other than the configuration of the elastic member 235, the rest of the configuration of the beater 200 may be identical to the configuration of the beater 100 described above.

Figure 5:
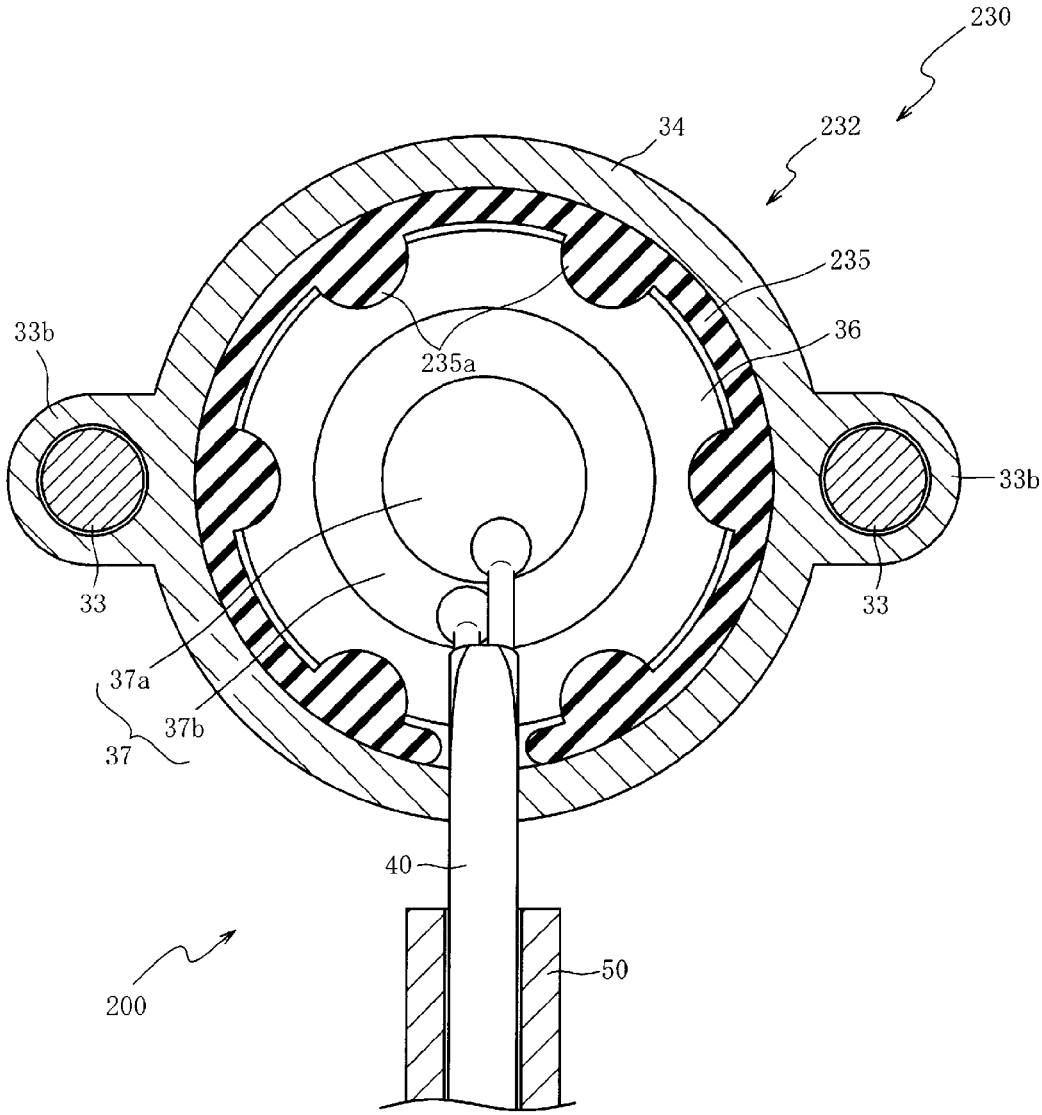
FIG. 5 is a cross section view of a beater of a second embodiment of the present invention.

As is shown in FIG. 5, the elastic member 235 dampens the vibrations and the impact force that are transmitted to the vibration sensor 37 from the main body 34 of the second striking member 232 when the head of the bass drum is struck by the striking member 230. The elastic member 235 is configured from an elastic body and is formed in any suitable shape, such as a generally cylindrical shape as shown in the drawing. In addition, the elastic member 235 has an inner peripheral surface with a diameter that is larger than the diameter of the plate 36 and, in addition, has six projection sections 235*a* that project inward from the inner peripheral surface. In an example embodiment, all of the projection sections 235*a* are arranged and spaced evenly around the circumferential direction. In addition, the diameter of a virtual circle that links the extended tips of the projection sections 235*a* is smaller than the diameter of the plate 36.

The plate 36 is arranged within the inner circumferential surface of the elastic member 235 and is held at portions, but not its entire peripheral edge by the projection sections 235*a* of the elastic member 235. Accordingly, the amount of the elastic member 235 that is used can be made small, the cost of the material of the elastic member 235 can be minimized. In addition, it is possible to minimize the weight of the beater 200, by minimizing the weight of the elastic member 235. In addition, in embodiments in which the projection sections 235*a* are arranged evenly in the circumferential direction, the plate 36 can be held evenly in the circumferential direction by the projection sections 235*a*. Therefore, it is possible to limit the direction that the vibration sensor 37, which is held via the plate 36, is likely to vibrate to one direction (in other words, the direction that is perpendicular to the first striking surface 31*a* (refer to FIG. 3(*b*)) or the second striking surface 32*a* (refer to FIG. 3(*b*)). Accordingly, vibrations of the striking member 230 can be reliably detected by the vibration sensor 37. In addition, in embodiments in which the peripheral portion of the plate 36 is held at equal intervals in the circumferential direction by the projection sections 235*a*, the projection sections 235*a* can attenuate evenly in the circumferential direction, undesired vibrations of the plate 36 that could otherwise remain after the head has been struck by the striking member 230.

An explanation of the present invention has been given above based on example embodiments; but the present invention is in no way limited to the example embodiments described above, but also includes various improvements and modifications that do not deviate from and are within the scope of the purport of the present invention.

For example, while in embodiments described above, the vibration sensor 37 is held by the elastic member 35 and 235 via the plate 36, in other embodiments, metal plate 37*b* of the vibration sensor 37 may be held directly by the elastic member 35 and 235. By omitting the plate 36, it is possible to reduce the component costs and weight of the beater 100 and 200.

While in embodiments described above, the plate 36, the piezoelectric element 37*a*, and the metal plate 37*b* are arranged parallel to the striking surface 31*a* and the end section 34*b*, in other embodiments the plate 36, the piezoelectric element 37*a*, and the metal plate 37*b* be arranged facing the first striking surface 31*a* and the second striking surface 32*a*, at an angle of inclination of 30° or less with respect to the first striking surface 31*a* and the second striking surface 32*a*. If the angle of inclination of the plate 36, the piezoelectric element 37*a*, and the metal plate 37*b* is greater than 30°, vibrations of the striking member 30 and 230, that are in the direction that is perpendicular to the first striking surface 31*a* and the second striking surface 32*a*, may not be reliably transmitted to the plate 36, the piezoelectric element 37*a*, and the metal plate 37*b*. However, in embodiments in which the angle of inclination of the plate 36, the piezoelectric element 37*a*, and the metal plate 37*b* with respect to the first striking surface 31*a* and the second striking surface 32*a* is made 30° or less, vibrations of the striking member 30 and 230 may be more reliably transmitted to the plate 36, the piezoelectric element 37*a*, and the metal plate 37*b*. Therefore, vibrations of the plate 36 are produced that more likely conform and correspond with vibrations of the striking member 30 and 230, resulting in corresponding bending of the piezoelectric element 37*a* and the metal plate 37*b*. Accordingly, vibrations of the striking member 30 and 230 can be reliably detected by the vibration sensor 37.

In addition, if the angle of inclination of the plate 36, the piezoelectric element 37*a*, and the metal plate 37*b* is greater than 30°, then the inertial force that is produced at the time that the head of the bass drum is struck would have a greater force component in the shear direction (the direction that is parallel to the attachment surface of the piezoelectric element and the metal plate) that operates on the piezoelectric element 37*a* and the metal plate 37*b*, which may more likely cause the piezoelectric element 37*a* and the metal plate 37*b* to separate from the plate 36. However, in embodiments in which the angle of inclination of the plate 36, the piezoelectric element 37*a*, and the metal plate 37*b* with respect to the first striking surface 31*a* and the second striking surface 32*a* is 30° or less, it is possible to minimize or reduce the component of the force in the shear direction that operates on the piezoelectric element 37*a* and the metal plate 37*b*. Therefore, separation of the piezoelectric element 37*a* and the metal plate 37*b* from the plate 36 can be minimized.

While in embodiments described above, the opening of the main body 34 of the second striking member 32 and 232 is closed by the occluding member 32*b* and the interior volume is closed, in other embodiments the occluding member 32*b* may be omitted and the vibration sensor 37 may be mounted in a manner that allows the vibration sensor 37 to be freely attached and detached from the plate 36 (or, together with the plate 36, from the elastic member 35 or 235). Accordingly, in the event that the vibration sensor 37 becomes damaged, the vibration sensor 37 can be detached and exchanged for a new vibration sensor 37. Therefore, the cost of replacement of a vibration sensor 37 can be reduced as compared to the case in which the entire second striking member 32 and 232 is changed.

While in embodiments described above, the inside of the second striking member 32 and 232 has a hollow, interior volume, in which the elastic member 35 and 235, the plate 36, and the vibration sensor 37 are attached, in other embodiments the inside of the first striking member 31 may have a hollow, interior volume in which the elastic member 35 and 235, the plate 36, and the vibration sensor 37 are attached.

While in embodiments described above, the second striking member 32 and 232 is mounted on the first striking member 31 in a manner to be freely attachable and detachable from the first striking member 31, in other embodiments, the second striking member 32 and 232 and the first striking member 31 may be formed as a single, unitary structure.

What is claimed is:

1. A percussion instrument striking detection device configured to be operatively connected to a foot pedal for rotational motion with a treading operation on the foot pedal, to strike a head of a percussion instrument, the percussion instrument striking detection device comprising:

a shaft member; and a striking member attached to the shaft member, the striking member having a hollow interior volume, an elastic member comprising an elastic material arranged inside of the hollow interior volume, and a vibration sensor held on the elastic material, the vibration sensor configured to vibrate within the hollow interior volume.

2. A percussion instrument striking detection device configured to be operatively connected to a foot pedal for rotational motion with a treading operation on the foot pedal, to strike a head of a percussion instrument, the percussion instrument striking detection device comprising:

a shaft member;

a striking member attached to the shaft member, the striking member having a hollow interior volume, an elastic member configured from an elastic material arranged inside of the hollow interior volume, and a vibration sensor held on the elastic material and configured to detect vibrations; and wherein the striking member further includes a sheet form plate held by the elastic member and configured of a material that is stiffer than the elastic material, and the vibration sensor is held on the elastic material via the plate.

3. The percussion instrument striking detection device of claim 2 wherein the striking member has an outer striking surface that is configured to hit and contact a head, and the vibration sensor comprises a plate form piezoelectric element that is arranged with a plate surface facing the striking surface, at an angle of inclination with respect to the striking surface that is 30° or less.

4. The percussion instrument striking detection device cited of claim 2 wherein the striking member comprises a first striking member that is fixed to the shaft member, and a second striking member that is selectively attachable onto and detachable from the first striking member, and the vibration sensor is located inside one of the first striking member or the second striking member.

5. The percussion instrument striking detection device of claim 2 wherein the vibration sensor is selectively attachable to and detachable from the elastic member.

6. The percussion instrument striking detection device of claim 2 wherein the vibration sensor is arranged at a center portion of the plate, and the plate has a peripheral portion that is held uniformly in the circumferential direction by the elastic member.

7. The percussion instrument striking detection device of claim 6 wherein the striking member has an outer striking surface that is configured to hit and contact a head, and the vibration sensor comprises a plate form piezoelectric element that is arranged with a plate surface facing the striking surface, at an angle of inclination with respect to the striking surface that is 30° or less.

8. The percussion instrument striking detection device cited of claim 6 wherein the striking member comprises a first striking member that is fixed to the shaft member, and a second striking member that is selectively attachable onto and detachable from the first striking member, and the vibration sensor is located inside one of the first striking member or the second striking member.

9. The percussion instrument striking detection device of claim 6 wherein the vibration sensor is selectively attachable to and detachable from the elastic member.

10. The percussion instrument striking detection device of claim 2 wherein the striking member has an outer striking surface that is configured to hit and contact a head, and the vibration sensor comprises a plate form piezoelectric element that is arranged with a plate surface facing the striking surface, at an angle of inclination with respect to the striking surface that is 30° or less.

11. The percussion instrument striking detection device cited of claim 10 wherein the striking member comprises a first striking member that is fixed to the shaft member, and a second striking member that is selectively attachable onto and detachable from the first striking member, and the vibration sensor is located inside one of the first striking member or the second striking member.

12. The percussion instrument striking detection device of claim 10 wherein the vibration sensor is selectively attachable to and detachable from the elastic member.

13. The percussion instrument striking detection device cited in claim 10 wherein the piezoelectric element is arranged with the plate surface parallel to the striking surface.

14. The percussion instrument striking detection device cited of claim 13 wherein the striking member comprises a first striking member that is fixed to the shaft member, and a second striking member that is selectively attachable onto and detachable from the first striking member, and the vibration sensor is located inside one of the first striking member or the second striking member.

15. The percussion instrument striking detection device of claim 13 wherein the vibration sensor is selectively attachable to and detachable from the elastic member.

16. A percussion instrument striking detection device configured to be operatively connected to a foot pedal for rotational motion with a treading operation on the foot pedal, to strike a head of a percussion instrument, the percussion instrument striking detection device comprising:

a shaft member;

a striking member attached to the shaft member, the striking member having a hollow interior volume, an elastic member configured from an elastic material arranged inside of the hollow interior volume, and a vibration sensor held on the elastic material and configured to detect vibrations; and wherein the striking member comprises a first striking member that is fixed to the shaft member, and a second striking member that is selectively attachable onto and detachable from the first striking member, and the vibration sensor is located inside one of the first striking member or the second striking member.

17. A percussion instrument striking detection device configured to be operatively connected to a foot pedal for rotational motion with a treading operation on the foot pedal, to strike a head of a percussion instrument, the percussion instrument striking detection device comprising:

a shaft member;

a striking member attached to the shaft member, the striking member having a hollow interior volume, an elastic member configured from an elastic material arranged inside of the hollow interior volume, and a vibration sensor held on the elastic material and configured to detect vibrations; and wherein the vibration sensor is selectively attachable to and detachable from the elastic member.

18. A percussion instrument striking detection device configured to be operatively connected to a foot pedal for rotational motion with a treading operation on the foot pedal, to strike a head of a percussion instrument, the percussion instrument striking detection device comprising:

a shaft member;

a striking member attached to the shaft member, the striking member having a hollow interior volume, an elastic member configured from an elastic material arranged inside of the hollow interior volume, and a vibration sensor held on the elastic material and configured to detect vibrations; and further comprising a cable for electrically connecting the vibration sensor to a sound source apparatus and a fixing piece that fixes the cable to the shaft member.

19. A percussion instrument striking detection device, comprising:

a shaft member; and a striking member attached to the shaft member and configured to strike a percussion instrument, the striking member having a body having a hollow interior volume, an elastic member attached to the body and located within the hollow interior volume of the body, and a vibration sensor supported on the elastic member, the vibration sensor configured to vibrate within the hollow interior volume.

20. The percussion instrument striking detection device of claim 1, wherein the vibration sensor is mounted on a sheet form plate and the hollow interior volume at least partially surrounds the sheet form plate and the vibration sensor.

21. The percussion instrument striking detection device of claim 1, wherein the hollow interior volume includes a hollow volume on each of at least two sides of the vibration sensor.

22. The percussion instrument striking detection device of claim 1, wherein the elastic member is in contact with an interior wall of the striking member and the vibration sensor is configured to be held by the elastic member such that the sensor is out of contact from the interior wall of the striking member.

23. The percussion instrument striking detection device of claim 1, wherein the elastic member has a first portion attached to an interior wall of the striking member and a second portion that is supported by the first portion in the hollow interior volume to vibrate out of contact with the interior wall.

24. The percussion instrument striking detection device of claim 23, wherein the first portion is a peripheral portion of the elastic member; and wherein the second portion is a central portion of the elastic member.

* * * * *